US006802765B1

(12) United States Patent
Torrez

(10) Patent No.: US 6,802,765 B1
(45) Date of Patent: Oct. 12, 2004

(54) STUD RESURFACING TOOL

(76) Inventor: Robert M. Torrez, 2812 Lake Hollow Rd., Berthoud, CO (US) 80513

( * ) Notice: Subject to any disclaimer, the term of this patent is extended or adjusted under 35 U.S.C. 154(b) by 0 days.

(21) Appl. No.: 10/465,313

(22) Filed: Jun. 19, 2003

(51) Int. Cl.[7] ..... B24B 23/00
(52) U.S. Cl. ..... 451/344; 451/521
(58) Field of Search ..... 451/344, 374, 451/490, 508, 509, 510, 500, 502, 514, 516, 520, 521, 523, 515, 548, 549, 550

(56) References Cited

U.S. PATENT DOCUMENTS 2,366,767 A * 1/1945 Brooks ..... 451/541
4,301,567 A * 11/1981 Tucker ..... 15/160
5,037,300 A * 8/1991 Weissman ..... 433/166
5,123,763 A * 6/1992 Simmons ..... 401/9
5,515,571 A * 5/1996 Grande ..... 15/220.4

* cited by examiner

*Primary Examiner*—Dung Van Nguyen
(74) *Attorney, Agent, or Firm*—William E. Hein

(57) ABSTRACT

A tool for resurfacing the area surrounding a protruding stud, without removing the stud from the member to which it is attached, includes a quick connect/disconnect coupler at one end thereof for attachment to and removal from a conventional rotary power tool. A central longitudinal aperture in the tool opens to a distal end thereof, and an abrasive surface preparation disc having a corresponding central aperture is adapted for removable attachment to the distal end of the tool. The tool is positioned over the stud such that the stud extends into the central aperture of the tool and the surface preparation disc is in contact with the surface area surrounding the stud. Controlled rotation of the tool in place over the stud results in a desired degree of uniform abrasion of the surface area surrounding the stud.

4 Claims, 1 Drawing Sheet

STUD RESURFACING TOOL

BACKGROUND AND SUMMARY OF THE INVENTION

This invention relates generally to engine rebuilding and, more specifically, to a tool for resurfacing the area immediately surrounding the studs that typically protrude upwardly from an engine block.

In the past, removal of oxidation and gasket residue from areas surrounding studs that project from engine blocks, cylinder heads, valve covers, transmission housings, and other surfaces has been accomplished either manually or with the assistance of a rotary disc grinder. Manual resurfacing of these areas using conventional emory cloth, for example, is very tedious, and even the use of a powered rotary disc grinder presents difficulties in that the grinder must be maneuvered completely around an exposed stud to effectively resurface the entire area immediately surrounding the stud.

It would therefore be advantageous to provide a tool that effectively cleans the surface surrounding an exposed stud without the necessity of removing the stud. In accordance with the illustrated preferred embodiment of the present invention, a tool body includes a quick connect/disconnect member at one end thereof for easy attachment to and removal from an angle die grinder or other rotary power tool. An opposite end of the tool body includes an axially-aligned aperture therein and means for receiving a surface conditioning disc having a central aperture that is coincident with the aperture in the tool body. In operation, the apertures in the tool body and attached surface conditioning disc are placed over a stud whose surrounding area is to be cleaned. Rotation of the tool body and surface conditioning disc around the stud serves to uniformly resurface the surrounding surface area without the need for repositioning the tool or removing the stud from the member in which it is embedded.

DETAILED DESCRIPTION OF THE INVENTION

Figure 1:
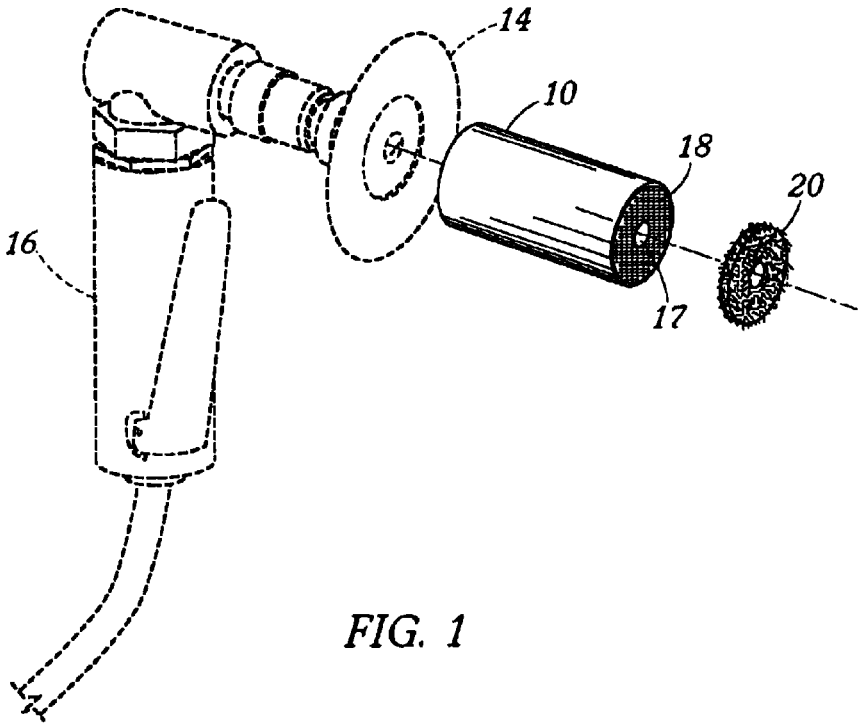
FIG. 1 is an exploded pictorial diagram illustrating the stud resurfacing tool of the present invention in combination with a surface conditioning disc and a conventional rotary grinder.
Figure 2:
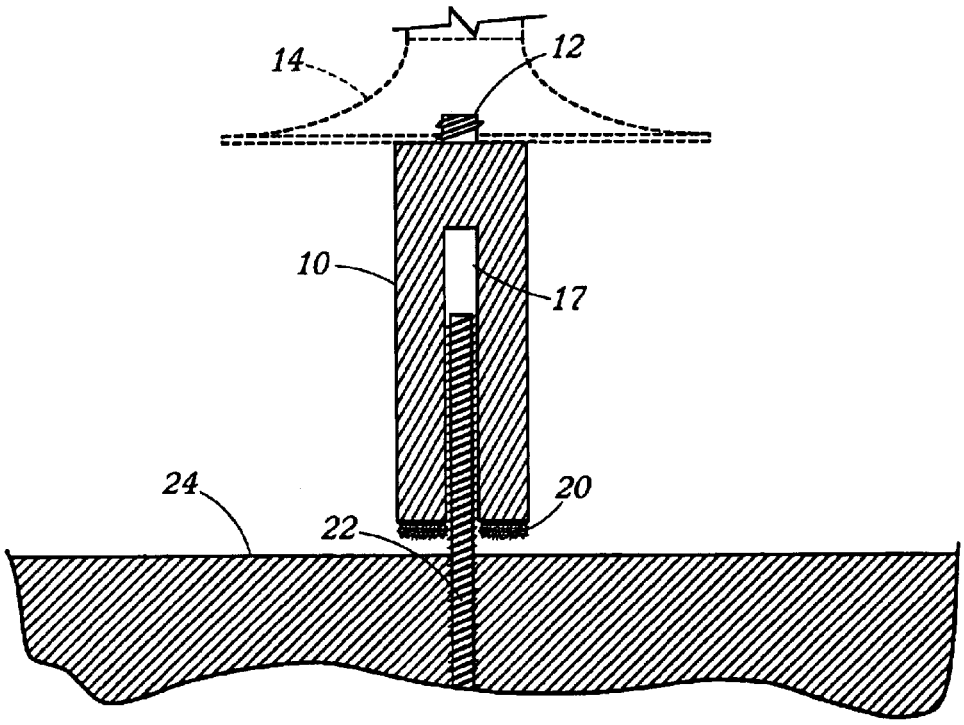
FIG. 2 is a cross-sectional diagram of the stud resurfacing tool of FIG. 1, illustrating the way it is positioned over a stud protruding from a housing member in which it is embedded in preparation for cleaning the surface area of the housing member immediately surrounding the protruding stud.

Referring now to FIGS. 1 and 2 of the drawings, a cylindrical tool body 10 includes any one of a number of conventional quick connect/disconnect members 12 that facilitates attachment to and removal from a rotating head 14 of a rotary grinder 16. Rotary grinder 16 may comprise any one of a number of commercially available surface preparation rotary tools, such as an angle die grinder. A central longitudinal aperture 17 in tool body 10 opens to a distal end thereof that is opposite rotary grinder 16. A hook or loop fastener disc 18 is permanently bonded to tool body 10 at its distal end such that no slippage occurs therebetween during rotation of tool body 10. Disc 18 includes a central aperture that is coincident with central aperture 17 in tool body 10. A surface preparation disc 20 also includes a central aperture and is backed with a hook or loop fastener material that mates with hook or loop fastener disc 18. Surface preparation disc 20 is preferably constructed of an abrasive material bonded to a supporting disc by means of a bonding material that is temperature resistant so as to prevent release of the abrasive material during use.

In operation, tool body 10, with surface preparation disc 20 attached thereto, is connected to head 14 of rotary grinder 16. Tool body 10 is then placed over a stud 22 protruding from a member 24 that may comprise an engine block, for example. Subsequent rotation of disc 20 by grinder 16 results in the quick and uniform removal of light oxidation and gasket residue from the surface surrounding stud 22. Tool body 10 is fabricated of a material that is softer than that of stud 22 to prevent damage thereto. Materials such as aluminum, wood, nylon, or various plastics are suitable for that purpose. The depth and diameter of central aperture 17 in tool body 10 are chosen to accommodate a particular size of stud 22.

I claim:

1. A stud resurfacing tool for use with a powered rotary tool, comprising:

a tool body having a connector at one end thereof to facilitate connection of the stud resurfacing tool to and disconnection from the powered rotary tool, said tool body having a central longitudinal aperture therein opening to a distal end thereof for receiving an external protruding stud; and a surface preparation disc attached to said distal end of said tool body, said surface preparation disc having a central aperture therein coincident with said central aperture in said tool body and having an outward facing abrasive surface, said surface preparation disc being adapted to be removably attached to said tool body in concert therewith.

2. A stud resurfacing tool as in claim 1, further comprising a hook or loop fastener disc fixedly attached to said distal end of said tool body and wherein said surface preparation disc comprises an inner hook or loop fastener surface to facilitate mating attachment of said surface preparation disc to said hook or loop fastener disc.

3. A stud resurfacing tool as in claim 1 wherein said tool body is generally cylindrical in shape.

4. A method for resurfacing a surface area surrounding a fixed protruding stud, the method comprising:

providing a tool body having a longitudinal central aperture therein, said aperture opening to a distal end of said tool body;

providing a surface preparation disc attached to said distal end of said tool body, said surface preparation disc having a central aperture therein coincident with said central aperture in said tool body and having a outward facing abrasive surface;

placing said tool body over said stud such that said stud extends into said aperture in said tool body and said abrasive surface of said surface preparation disc is in contact with the surface area surrounding said stud; and rotating said tool body in place over said stud to achieve a desired degree of abrasion of said surface area surrounding said stud.

* * * * *